United States Patent [19]

Zigman

[11] Patent Number: 4,640,199

[45] Date of Patent: Feb. 3, 1987

[54] MOBILE TERMINAL MOUNTING STAND

[76] Inventor: Donald J. Zigman, 5569 S. 116th St., Hales Corners, Wis. 53130

[21] Appl. No.: 712,601

[22] Filed: Mar. 15, 1985

[51] Int. Cl.[4] ..... A47B 9/14

[52] U.S. Cl. ..... 108/6; 108/92; 108/7; 312/208

[58] Field of Search ..... 108/5, 6, 7, 8, 92, 108/93, 96, 147; 312/194, 196, 208, 281

[56] References Cited

U.S. PATENT DOCUMENTS

| | | | |
|---|---|---|---|
| 444,663 | 1/1891 | Collier | 108/7 |
| 3,847,461 | 11/1974 | Moeckl | 312/281 |
| 4,313,112 | 1/1982 | Foster | 340/700 |
| 4,345,803 | 8/1982 | Heck | 312/194 |
| 4,418,967 | 12/1983 | Winkleman | 312/194 X |
| 4,428,631 | 1/1984 | Cope et al. | 312/208 X |
| 4,515,086 | 5/1985 | Kwiecinski et al. | 312/196 X |
| 4,541,343 | 9/1985 | Erad | 108/92 |

FOREIGN PATENT DOCUMENTS

| | | | |
|---|---|---|---|
| 128263 | 12/1984 | United Kingdom | 108/6 |

OTHER PUBLICATIONS

Video Display Terminals, Preliminary Guidelines for Selection, Installation and Use by AT&T Bell Laboratories, pp. 9–29.

*Primary Examiner*—Peter A. Aschenbrenner
*Attorney, Agent, or Firm*—Quarles & Brady

[57] ABSTRACT

A computer terminal work station assembly that includes a mobile mounting stand for a video display terminal (VDT), a keyboard, disc drive, printer paper and printer holding elements. The stand has two upright joining members arranged so a work surface with the VDT immediately to the rear of the keyboard tilts away so that the screen of the VDT tilts from an angle of 90 degrees with reference to the work surface to 0 degrees with reference to the work surface. A printer paper support surface and printer support surface are located above and forward of the VDT to hold printer paper and a printer and to shield the VDT screen from any overhead light and other room reflections. A shelf is positioned below and diagonal to the work surface to hold the disc drive and provide ballast for the assembly.

6 Claims, 5 Drawing Figures

MOBILE TERMINAL MOUNTING STAND

BACKGROUND OF THE INVENTION

The present invention relates in general to computer terminal work station assemblies. In particular, the invention relates to a mobile and compact mounting stand in which a video display terminal (VDT) tilts dramatically and provides for the arrangement of the VDT, keyboard, disc drive, printer paper and printer for such work station assemblies.

Heretofore computer work station assemblies generally employed conventional office furniture ergonomics that positioned the VDT, keyboard, disc drive, printer paper and printer before the operator with the disc drive immediately to the rear of the keyboard. The VDT was mounted above the disc drive with a 15 to 30 degree viewing angle adjustment with respect to the operator's line of sight to the center of the screen and with reference to the horizon. The printer paper and printer were located nearby or adjacent to the same work surface. Generally these work station assemblies represented compromises by the designers to accommodate office environmental factors such as overhead lighting and room reflections; human factors such as recommended sight distances of 15 to 35 inches and corrective vision and economic factors such as manufacturing, packaging and distribution. Coupled with the prior art described above is an exponential proliferation of computer technology into the administrative office.

This reality has produced three separate but related trends in business. First, manufacturers of computer technology for the administrative office are trending toward producing modular components with the VDT, keyboard, disc drive, and printer as separate components cabled together to produce the technical computer terminal work station assemblies. Second, this technology had previously emphasized production work station circumstances in performing data entry and data retrieval tasks. In the administrative office data inquiry is the preponderent function performed on an intermittent basis. Third, the operators at production work assemblies were and are younger, lower level employees. In the administrative office, these operators are generally older, higher level administrative and executive employees which has resulted in greater numbers of operators with bi- and tri-focal lenses and a greater exposure to neck and back discomfort using conventional assemblies. Conventional assemblies, therefore, have resulted in computer work stations causing increasing operator fatigue, eye strain and neck and back discomfort.

These and other disadvantages of the prior art are overcome by a work station assembly constructed in accordance with the present invention, which mounts the VDT on a portion of the work surface, that tilts away from a screen position vertical to the work surface to level with the work or a 90 degree adjustment and attached to two vertical upright members.

A further advantage of the present invention are shelves attached to the vertical upright members above the VDT and offset forward to shield any overhead light and room reflections and act as the printer and printer paper support.

A still further advantage of the present invention is a shelf attached to the upright members below the work surface that holds the keyboard and VDT to hold the disc drive and act as a ballast for the assembly.

Advantageously, the computer terminal work station assembly thus constructed, permits the operator to adjust the VDT to any desired viewing angle from 90 degrees to 0 degrees and a variable viewing distance without overhead light and room reflections and meeting the vision requirements of operators with bi- and tri-focal glasses.

Other features and advantages of the invention are set forth in or are apparent from the detailed description of preferred embodiments found hereinbelow.

SUMMARY OF THE INVENTION

The foregoing advantages are accomplished by the present mounting stand for a video display terminal as well as a keyboard, disc drive, printer paper and printer. The stand includes a first portion which has a first support work surface for the keyboard and a moveable section which is constructed and arranged to tilt from the keyboard work surface and provide a support for the VDT. The second portion provides a second support surface at a height greater than a portion of the first work support surface. The third portion provides a third support surface at a height greater than the second support surface and is in alignment with at least a portion of the first support work surface. The second and third support surfaces provide support for the printer paper and the printer. A fourth portion provides a support member and is spaced at a height lower than the first support work surface for holding the disc drive. A frame support means, including vertical upright members, innerconnects the first, second and third support surfaces and the fourth support member to provide an integral assembly.

Preferably, the mounting stand includes roller members operatively connected to the frame support means and the first portion includes means to tilt the moveable section at an angle in the range of about 0 to 90 degrees. Also preferably, the fourth support member is disposed downwardly and away from the first work surface to provide easy access to the disc drives and a ballast function.

BRIEF DESCRIPTION OF THE DRAWING

A better understanding of the present mounting stand will be accomplished by reference to the drawings wherein.

Figure 1:
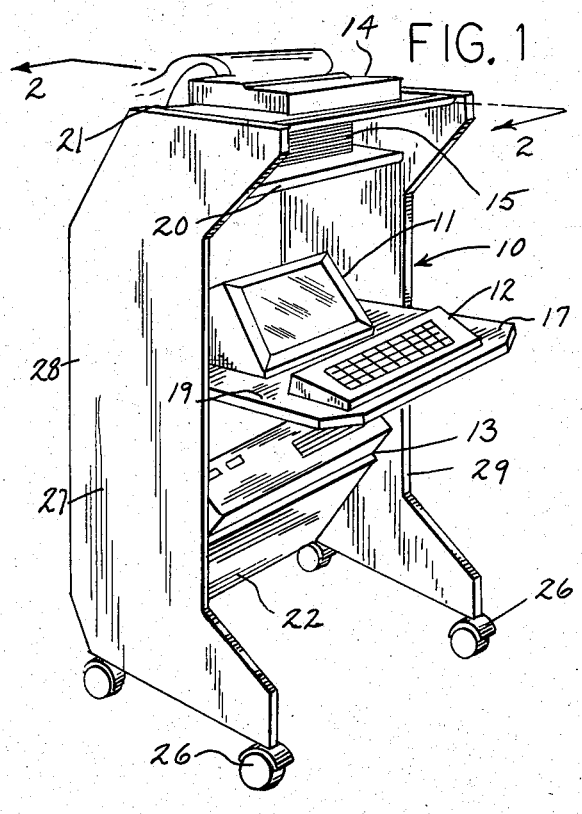
FIG. 1 is a perspective view of the present mounting stand supporting the usual computer work station components.
Figure 2:
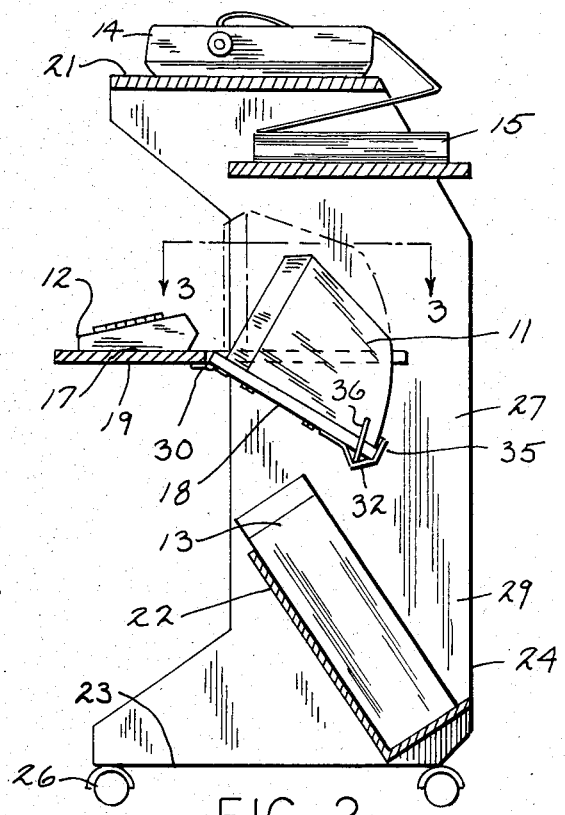
FIG. 2 is a view in side elevation with portions broken away illustrating the tilting of the VDT.

Proceeding to a detailed description of the present invention and referring particularly to FIGS. 1 and 2, a VDT 11, as well as a keyboard 12 are shown supported on a work support surface 17. A printer paper feed 15 is supported on a support surface 20 and in a similar manner, paper printer 14 is supported on support surface 21. At the bottom of the mounting stand 10 a disc drive 13 is shown in an angular position. It is housed by a support member 22 which will be supported on base 23, as well as being connected to the back wall 24. It will be noted with respect to FIG. 2 that the support member 22 is in the form of a shelf and is of a generally L-shaped configuration in cross section. It should also be further noted that the work support surface 17 includes a stationary section 19 and a moveable section 18 with the two sections being interconnected by the hinge 30. The work support surfaces 17, 20 and 21 as well as the support member 22 are interconnected into an integral frame 27 by the vertical supports or side walls 28 and 29.

Figure 3:
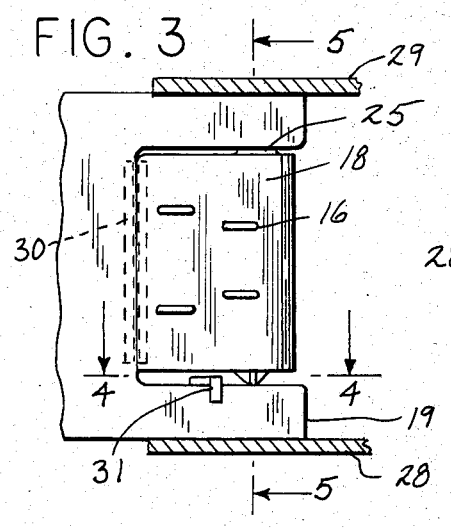
FIG. 3 is a view in horizontal section taken along line 3—3 of FIG. 2.
Figure 5:
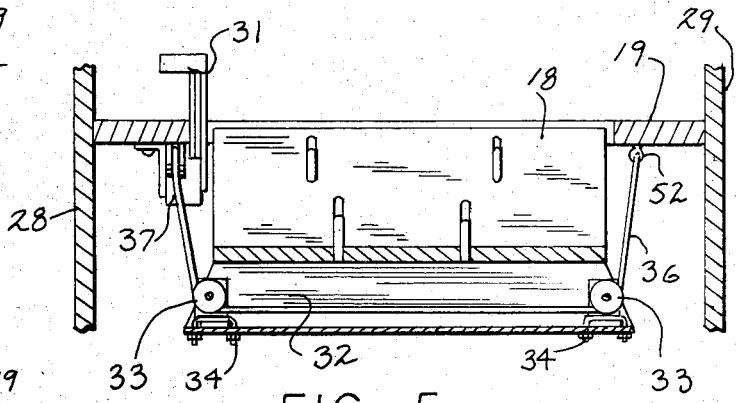
FIG. 5 is a view in vertical section taken along line 5—5 of FIG. 3 but with the support surface in a lowered position.
Figure 4:
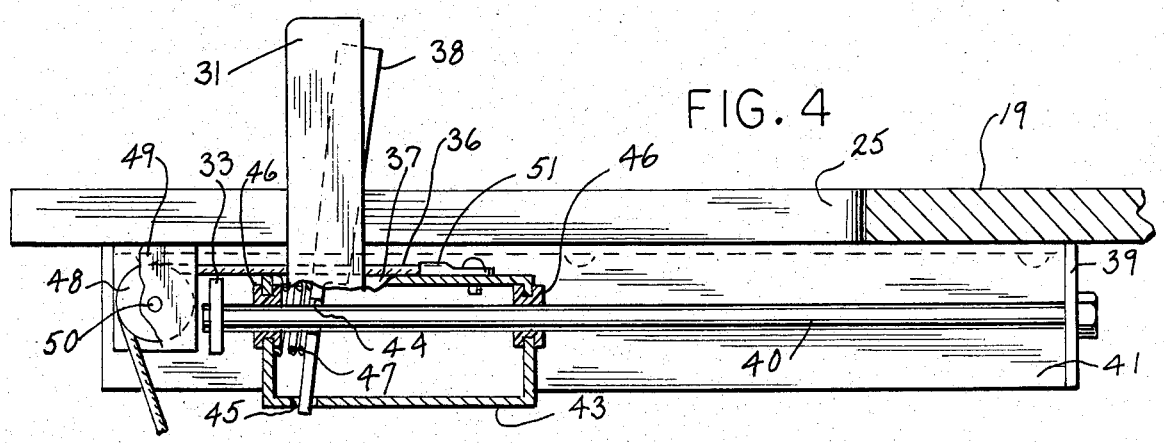
FIG. 4 is a view in vertical section taken along line 4—4 of FIG. 3.

FIGS. 3, 4 and 5 illustrate the tilting mechanism for the moveable section 18. Referring specifically to FIG. 3 it will be seen that the moveable section 18 has apertures 16 for the purpose of mounting the VDT. Secured in a transverse manner to the end of the moveable section 18 at an end opposite to hinge 30 is a trough-like bracket 32 which has pulleys 33 rotatably mounted therein such as by means of clamps 34. A cable 36 is connected to the underside of stationery section 19 such as by the usual support hook 52 and extends under the pulleys 33 as well as upwardly and over the guide pulley 48 (See FIG. 4). At the opposite end, the cable 36 is attached to the upper portion of a brake-slider assembly 37 by the usual connector 51.

The brake-slider assembly 37 includes an upwardly extending brake lever housing 31 for the brake lever 38 which has a passage 44 for accommodating the guide rod 40. The brake-slider assembly includes a housing 43 with a passage 45 to accommodate an end portion of the pivoting brake lever 38. A spring 47 provides a biased pivotal action. The brake-slider assembly 37 includes bushings 46 which will slidably accommodate guide rod 40. The guide rod 40 is suitably secured to the stationary section 19 such as by the lateral support bracket 41 and the transverse portion 39, as well as the transverse portion 53. Also supported by the support bracket 41 is the guide pulley 48 which is rotatably mounted between the lateral plates 49 secured to the support bracket 41 by the shaft 50 which will also rotatably support the guide pulley 48.

OPERATION

A better understanding of the advantages of the mounting stand 10 will be had by a description of its operation. Under normal circumstances, the stand will have supported thereon the VDT 11 and keyboard 12, as well as a paper printer 14 and the paper feeder 15 as indicated in FIG. 1. It should be appreciated that the positioning of the disc drive 13 in the angular manner afforded by the support member 22 will provide a low center of gravity for the supported weight of the mounting stand and thus afford a ballast feature. It is appreciated that when an operator sits in the front of work support surface 17 that the operator's height and distance from the VDT will affect the operator's reading of the display terminal. To compensate for these variables, the mounting stand 10 affords a moveable section 18 which can be readily tilted by mere operation of the brake lever 38.

Referring to FIG. 4, it will be observed that movement of the brake lever 38 to a more upright position will align the passage 44 with the rod 40 thereby allowing the brake lever 38, as well as the entire brake assembly housing 43 to move over the rod 40. This movement in the direction toward the back of the mounting stand or the guide 48 will cause the cable 36 to ride over guide pulley 48 as well as under the pulleys 33. This in effect increases the length of cable extending under the stationary section 19 thus permitting the moveable section 18 to tilt or drop downwardly as indicated in FIG. 2. Movement of the brake assembly housing 43 over the rod affords incremental adjustment of the VDT. Accordingly, fast and easy adjustment of tilt angle of the VDT is effected which can easily be made between an angle of 0 and 90 degrees from the horizontal. This is in addition to other referred to advantages reduces the distance of eye movement from the VDT to the keyboard. It will be appreciated that when a force is not exerted on the brake lever 38 the bias provided by the spring 47 will cause it to resume the lock position as indicated in FIG. 4.

In addition to the tilting feature, another important feature of the mounting stand 10 is the fact that an extension of the support surface 20 as well as 21 over the VDT 11 will provide a shield from direct lighting onto the VDT which provides for an easier reading of the display. As indicated earlier, the positioning of a disc drive 13 in an angular manner is important to provide easy access to the disc drives and stability to the frame stand 27. This weight balance becomes important when the stand 27 is moved from one area to another such as by the rollers 26.

It will be appreciated from the foregoing description that a computer terminal assembly work station constructed in accordance with the present invention reduces the distance of eye movement from the VDT to the keyboard. It also reduces the frequency in differences in focal length changes from the VDT to the keyboard. In addition, it permits the operator to assume a natural sitting position as well as permitting bi- and tri-focal eye glass wearers to view the VDT through those lenses with a natural position of the head, all of which combine to dramatically reduce eye strain and back discomfort.

Although the invention has been described with respect to certain embodiments thereof, it will be understood that variations and modifications can be affected in the embodiment without departing from the essence, scope or spirit of the invention. For example, while a particular tilt mechanism has been described which includes a brake-slider assembly 37, other mechanisms which could be used to tilt moveable section 18 as well as the VDT would be latch and catch mechanisms, counter balancing weight tilt mechanisms such as of the spring loaded lever type, or weight loaded pulleys.

I claim:

1. A mounting stand for supporting a video display terminal, keyboard, disc drive, printer, and printer paper on a floor comprising:

a first portion defining a forward keyboard support surface and a rearward VDT support surface, said VDT support surface being hingedly connected to said keyboard support surface;

means for adjusting the inclination of said VDT support surface relative to said keyboard support surface;

a second portion defining a paper support surface at a height above said VDT support surface, at least a portion of said paper support surface being vertically aligned with a portion of said VDT support surface;

a third portion defining a printer support surface above said paper support surface wherein at least a portion of said printer support surface is forward of said VDT support surface;

a fourth portion defining a disc drive support member at a height below said VDT support surface, at least a portion of said disc drive support member being rearward of said keyboard support surface;

frame support means interconnecting said first, second, third and fourth portions; and roller means operatively connected to the frame support means to contact the floor, said roller means being disposed at two places rearward of the VDT support surface, one on each side of the mounting stand, and at two places forward of the VDT support surface, one on each side of the mounting stand.

2. A mounting stand as in claim 1, wherein the inclination of the VDT support surface is adjustable from 0–90 degrees relative to the keyboard support surface.

3. A mounting stand as in claim 2, wherein the disc drive support member slopes downwardly from front to rear to support the disc drive in a position accessible to a user.

4. A mounting stand as in claim 3, wherein at least a portion of the paper support surface is rearward of the printer support surface to provide a paper path from the paper support surface to the printer support surface.

5. A mounting stand as in claim 4, wherein at least a portion of the printer support surface is forward of the paper support surface.

6. A mounting stand as in claim 5, wherein a portion of the printer support surface is vertically aligned with a portion of the keyboard support surface.

* * * * *